US009865374B1

(12) United States Patent
Hayashishita et al.

(10) Patent No.: US 9,865,374 B1
(45) Date of Patent: Jan. 9, 2018

(54) MULTI-CORE CABLE

(71) Applicant: SUMITOMO ELECTRIC INDUSTRIES, LTD., Osaka-shi, Osaka (JP)

(72) Inventors: Tatsunori Hayashishita, Aomori (JP); Kazuhiro Sato, Tochigi (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/418,864

(22) Filed: Jan. 30, 2017

(51) Int. Cl.

| | |
|---|---|
| ***H01B 7/00*** | (2006.01) |
| ***H01B 11/20*** | (2006.01) |
| ***H01B 7/02*** | (2006.01) |
| ***H01B 7/18*** | (2006.01) |
| ***H01B 7/04*** | (2006.01) |
| ***H01B 7/28*** | (2006.01) |

(52) U.S. Cl.
CPC ..... *H01B 7/0009* (2013.01); *H01B 7/02* (2013.01); *H01B 7/04* (2013.01); *H01B 7/18* (2013.01); *H01B 7/28* (2013.01); *H01B 11/20* (2013.01)

(58) Field of Classification Search
CPC ..... H01B 7/0009; H01B 7/02; H01B 7/04; H01B 7/18; H01B 7/28; H01B 11/20
USPC ..... 174/105 R
See application file for complete search history.

(56) References Cited

U.S. PATENT DOCUMENTS

2009/0244144 A1* 10/2009 Mataki ..... B41J 2/2132 347/14
2010/0228088 A1* 9/2010 Ozaki ..... A61B 1/00096 600/140
2015/0083458 A1 3/2015 Tanaka et al.

FOREIGN PATENT DOCUMENTS

JP 03039710 * 2/1991
JP 2013-251257 A 12/2013

* cited by examiner

*Primary Examiner* — Timothy Thompson
*Assistant Examiner* — Charles Pizzuto
(74) *Attorney, Agent, or Firm* — Drinker Biddle & Reath LLP

(57) ABSTRACT

A multi-core cable includes a plurality of coaxial wires, each coaxial wire including a center conductor whose sectional area is 0.0006 $mm^2$ to 0.25 $mm^2$, a wrapping tape configured to cover all of the plurality of coaxial wires, and a sheath configured to cover the wrapping tape. The sheath is configured by a resin material coated with polyparaxylylene or fluorine resin in a thickness of 0.5 μm to 3.0 μm.

8 Claims, 1 Drawing Sheet

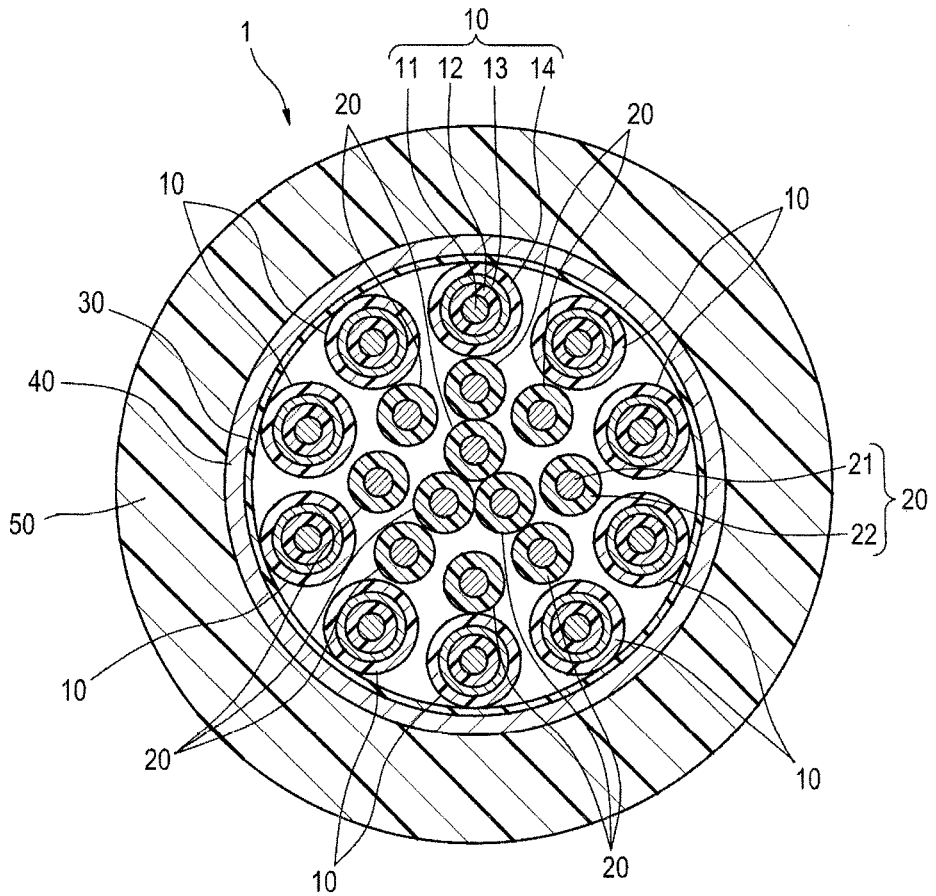
1
10
11
12
13
14
20
20
10
10
30
40
21
20
22
50
10
20
10
10
20

MULTI-CORE CABLE

BACKGROUND

Technical Field

The present invention relates to a multi-core cable having a plurality of coaxial wires.

Related Art

Patent Document 1 discloses a multi-core cable having a plurality of coaxial wires, a plurality of insulated wires and a sheath configured to cover the plurality of coaxial wires and the plurality of insulated wires. The sheath disclosed in Patent Document 1 is formed of polyvinyl chloride (PVC), polyolefin-based resin or the like.

[Patent Document 1] Japanese Patent Application Publication No. 2013-251257A

In the multi-core cable, PVC, polyurethane (PUR) and silicone are generally used as the material of the sheath, as disclosed in Patent Document 1. In a multi-core cable for medical devices, an ultrafine multi-core cable having excellent chemical resistance and high flexibility is needed. However, the multi-core cable where the conventional sheath material such as PVC, polyurethane, silicone or the like is used may be discolored or altered by temporal change due to chemicals. Therefore, it is needed to further improve the chemical resistance while maintaining the high flexibility.

SUMMARY

The present invention provides a small-diameter multi-core cable capable of satisfying desired chemical resistance and high flexibility.

A multi-core cable according to the present invention comprises:

a plurality of coaxial wires, each coaxial wire including a center conductor whose sectional area is 0.0006 $mm^2$ to 0.25 $mm^2$;

a wrapping tape configured to cover all of the plurality of coaxial wires, and a sheath configured to cover the wrapping tape, wherein the sheath is configured by a resin material coated with polyparaxylylene or fluorine resin in a thickness of 0.5 μm to 3.0 μm.

According to the present invention, it is possible to provide the multi-core cable of which the sheath is difficult to be altered and has a long lifespan due to improvements on the chemical resistance and the high flexibility and the peeling resistance of the coating layer are favorable.

BRIEF DESCRIPTION OF THE DRAWINGS

FIG. 1 is a sectional view depicting an example of a multi-core cable in accordance with an exemplary embodiment of the present invention.

DETAILED DESCRIPTION

Description of Exemplary Embodiment of Present Invention

First, an exemplary embodiment of the present invention will be described.

(1) A multi-core cable according to an exemplary embodiment of the present invention comprises:

a plurality of coaxial wires, each coaxial wire including a center conductor whose sectional area is 0.0006 $mm^2$ to 0.25 $mm^2$;

a wrapping tape configured to cover all of the plurality of coaxial wires, and a sheath configured to cover the wrapping tape, wherein the sheath is configured by a resin material coated with polyparaxylylene or fluorine resin in a thickness of 0.5 μm to 3.0 μm.

According to a configuration of the exemplary embodiment, it is possible to provide a multi-core cable of which chemical resistance is improved and the flexibility and the peeling resistance of the coating layer are favorable.

(2) It is preferable that a number of the plurality of coaxial wires is 2 to 300.

(3) It is preferable that an outer diameter of the entire cable is 0.5 mm to 10.0 mm.

According to the configuration of the exemplary embodiment, it is possible to make a diameter of the multi-core cable small while maintaining the favorable chemical resistance and high flexibility.

(4) It is preferable that the multi-core cable further comprises:

a plurality of insulated wires within the wrapping tape, each insulated wire including a conductor whose sectional area is 0.0006 $mm^2$ to 0.25 $mm^2$.

Details of Exemplary Embodiment of Present Invention

Hereinafter, an example of the exemplary embodiment of the multi-core cable of the present invention will be described with reference to the drawings.

FIG. 1 is a sectional view of a multi-core cable of the exemplary embodiment.

As shown in FIG. 1, a multi-core cable 1 of the exemplary embodiment includes a plurality of (ten, here) coaxial wires 10 and a plurality of (eleven, here) insulated wires 20 arranged within a circle formed by the plurality of coaxial wires 10. Also, the multi-core cable 1 has a wrapping tape 30 configured to cover the plurality of coaxial wires 10 and the plurality of insulated wires 20, a shield layer 40 configured to cover the wrapping tape 30, and a sheath 50 configured to cover the shield layer 40.

Each coaxial wire 10 has a center conductor 11 arranged at a center thereof, an inner insulator 12 arranged at an outer side of the center conductor 11, an outer conductor 13 arranged at an outer side of the inner insulator 12, and an outer insulator 14 arranged at an outer side of the outer conductor 13. In the meantime, as the coaxial wire 10 of the example, a coaxial wire of which a sectional area of the center conductor 11 is 0.0006 $mm^2$ to 0.25 $mm^2$ (AWG (American Wire Gauge) 24 to 49) is used.

Each insulated wire 20 has a conductor 21 arranged at a center thereof and an insulator 22 arranged at an outer side of the conductor 21. In the meantime, as the insulated wire 20 of the example, an insulated wire of which a sectional area of the conductor 21 is 0.0006 $mm^2$ to 0.25 $mm^2$ (AWG (American Wire Gauge) 24 to 49) is used.

At a center part of the multi-core cable 1, the plurality of insulated wires 20 is arranged and the plurality of coaxial wires 10 is arranged around there so as to form a circle. The wrapping tape 30 is wrapped around the plurality of coaxial wires 10 arranged in the circle shape in this way. That is, the wrapping tape 30 is configured to cover all of the plurality of coaxial wires 10 and the plurality of insulated wires 20 configuring the multi-core cable 1. In the meantime, as the wrapping tape 30, a resin tape having a copper foil, an aluminum foil or the like adhered thereto or a resin tape having a metal material vapor-deposited thereto can be used, for example.

A thin metal wire is helically wrapped around the wrapping tape 30, so that the shield layer 40 is formed. The shield layer 40 may also be formed by braiding the thin metal wire around the wrapping tape 30. On the other hand, the shield layer may not be provided and the sheath 50 (which will be described later) may be covered around the wrapping tape 30.

The sheath 50, which is the outermost layer covering of the multi-core cable 1, is covered around the shield layer 40. As a material of the sheath 50, a material in which polyparaxylylene having excellent waterproofness and chemical resistance is coated in a thickness of 0.5 nm to 3.0 μm around the conventional sheath material such as PVC, PUR, silicone or the like is used. Polyparaxylylene is coated on a surface of PVC, PUR, silicone or the like, so that the chemical resistance can be remarkably improved. In the meantime, when the thickness of the coating layer of polyparaxylylene is smaller than 0.5 μm, the coating layer may be peeled off by bending of the cable. Also, when the thickness of the coating layer is greater than 3.0 μm, the high flexibility of the cable is not maintained.

Therefore, when the coating layer of polyparaxylylene having a thickness of 0.5 μm to 3.0 μm is provided on the surface of the sheath 50, it is possible to provide the multi-core cable 1 of which the chemical resistance is improved and the high flexibility and the peeling resistance of the coating layer are favorable. In the meantime, a fluorine resin (PFA, ETFE, FEP, THV or the like) may be coated around the conventional sheath material, instead of polyparaxylylene. The coating may be recoated in several batches.

The multi-core cable 1 shown in FIG. 1 is a multi-core cable of 21 wires including the ten coaxial wires 10 and the eleven insulated wires 20, for example. However, the numbers and arrangements of the coaxial wires 10 and the insulated wires 20 are not limited to this example. However, a total sum of the wires 10, 20 included in the multi-core cable 1 is preferably 2 to 300. When the total sum of the wires 10, 20 is smaller than 2, it is not possible to apply the multi-core cable to a desired utility. Also, when the total sum of the wires 10, 20 is greater than 300, it is not possible to make a diameter of the multi-core cable 1 small. In a multi-core cable including more wires than the example of FIG. 1, several wires to several tens of wires may be treated as one unit, and the wrapping tape may be wrapped around each unit. In this case, after the units are twisted, an outer wrapping tape is wrapped around of the plurality of twisted units and the shield layer and sheath are covered around the outer wrapping tape. That is, the units each of which includes several wires to several tens of wires are included in the multi-core cable, so that the multi-core cable including several wires to 300 wires may be configured.

An outer diameter of the multi-core cable 1 is different depending on the number of the wires included in the multi-core cable 1. However, the outer diameter is preferably set to be 0.5 mm to 10.0 mm, for example. In the meantime, a relation between the outer diameter of the multi-core cable 1 and the number of the wires included in the multi-core cable 1 is as follows. For example, in the multi-core cable 1 of 21 wires shown in FIG. 1, an outer diameter thereof is 2.0 mm, and in the multi-core cable of 300 wires, an outer diameter thereof is 10.0 mm.

Embodiments

Embodiments of the multi-core cable 1 described in the above exemplary embodiment are described. Regarding the multi-core cable, the flexibility, the peeling of the coating and the chemical resistance were evaluated. As the multi-core cable for test of an evaluation target, a multi-core cable having an outer diameter of 10.0 mm and including the shield layer, which was configured by a braid of a silver-plated copper alloy wire having a wire diameter of 0.08 mm, was used. In an example 1, the sheath configured to cover the shield layer was configured only by silicone having a thickness of 1.0 mm (polyparaxylylene was not coated), and in examples 2 to 7, the sheath was coated with polyparaxylylene having a thickness of 0.1 μm to 3.5 μm around silicone having a thickness of 1.0 mm, respectively.

(Flexibility)

In the evaluation of the flexibility, the bending moments (gf·cm), which were obtained when the multi-core cables of the examples 1 to 7 were respectively bent by 15°, were measured using a Stiffness Tester. The results are shown in Table 1. In the meantime, when the bending moment was 300 gf·cm or less, the multi-core cable was regarded as highly flexible.

(Peeling of the Coating)

The multi-core cables of the examples 1 to 7 were respectively held by a mandrel having a diameter of 12 mm, a weight of 1 kg was suspended to each cable, and each cable was then bent at right and left sides by 90° (a total of 180°). During the bending test of hundred thousand times, when it was not observed that the coating layer of polyparaxylylene was peeled off from silicone, the cable was accepted (OK) and when the peeling was observed, the cable was rejected (NG). The results are shown in Table 1.

(Chemical Resistance)

The sheath materials (examples 2 to 7) of which polyparaxylylene was coated around silicone were immersed in a 2% glutaraldehyde solution for 7 days. In the meantime, as a control example (example 1), the sheath material of which silicone was not coated with polyparaxylylene was also immersed in the chemical solution. The results are shown in Table 1.

TABLE 1

| Embodiments | Coating thickness [μm] | Chemical resistance test (*1) | Flexibility evaluation (bending moment [gf · cm]) | Peeling of coating (*2) |
|---|---|---|---|---|
| Example 1 | — | NG | 275 | — |
| Example 2 | 0.1 | OK | 275 | NG |
| Example 3 | 0.5 | OK | 280 | OK |
| Example 4 | 2.0 | OK | 290 | OK |
| Example 5 | 2.5 | OK | 300 | OK |
| Example 6 | 3.0 | OK | 330 | OK |
| Example 7 | 3.5 | OK | 350 (NG) | OK |

(*1) OK: not discolored/altered, NG: discolored/altered
(*2) OK: not peeled off, NG: peeled off As shown in Table 1, in the flexibility evaluation, in the examples 1 to 5 where the thickness of the coating layer of polyparaxylylene was 0.0 μm (no coating) to 2.5 μm, the multi-core cable had the bending moment of 300 gf·cm or less and the high flexibility. Also, in the example 6 where the thickness of the coating layer was 3.0 μm, the bending moment was 330 gf·cm, which is an upper limit of the bending moment at which it can be said that the multi-core cable has the flexibility. That is, it can be seen that when the thickness of the coating layer exceeds 3.0 μm, the multi-core cable lacks the flexibility and is stiff.

In the peeling evaluation, in the examples 3 to 7 (the thickness of the coating layer was 0.5 μm to 3.5 μm), the coating layer was not peeled off even under hundred thousand tests. However, in the example 2 where the coating layer was thin (the thickness was 0.1 μm), it was observed that the coating layer was peeled off. In general, when an outer diameter of a cable is thick, the coating is likely to be peeled off. In the examples, the cable having the outer diameter of 10 mm was evaluated. Therefore, even for a cable having an outer diameter smaller than 10 mm, it can be concluded that when the thickness of the coating layer is 0.5 μm or greater, the requirement that the coating does not peel is satisfied.

In the chemical resistance evaluation, as shown in Table 1, in the sheath materials (the examples 2 to 7) having the coating layer of polyparaxylylene, the coating layer was not discolored or altered. However, the sheath material (the example 1) where polyparaxylylene was not coated was discolored or altered.

From the above, it could be confirmed that when polyparaxylylene is coated on the surface of PVC, PUR or silicone configuring the conventional sheath material, the chemical resistance can be considerably improved. In particular, from the result of Table 1, it could be confirmed that when the thickness of the coating layer of polyparaxylylene is set to 0.5 μm to 3.0 μm, it is possible to improve the chemical resistance without deteriorating the flexibility of the cable and the peeling resistance of the coating layer (the peeling of the coating of the cable).

Although the present invention has been described in detail with reference to the specific exemplary embodiment, a variety of changes and modifications can be made without departing from the spirit and scope of the present invention.

In the above exemplary embodiment, the multi-core cable 1 is configured as a cable of a complex type including the plurality of coaxial wires 10 and the plurality of insulated wires 20. However, the insulated wires 20 may not be included. When a multi-core cable including only coaxial wires has the same configuration as the exemplary embodiment, it is possible to obtain a multi-core cable having a small diameter and satisfying the desired chemical resistance and the high flexibility.

What is claimed is:

1. A multi-core cable comprising:

a plurality of coaxial wires, each coaxial wire including a center conductor whose sectional area is 0.0006 $mm^2$ to 0.25 $mm^2$;

a wrapping tape configured to cover all of the plurality of coaxial wires, and a sheath configured to cover the wrapping tape, wherein the sheath is configured by a resin material coated with polyparaxylylene or fluorine resin in a thickness of 0.5 μm to 3.0 μm.

2. The multi-core cable according to claim 1, wherein a number of the plurality of coaxial wires is 2 to 300.

3. The multi-core cable according to claim 1, wherein an outer diameter of the entire cable is 0.5 mm to 10.0 mm.

4. The multi-core cable according to claim 2, wherein an outer diameter of the entire cable is 0.5 mm to 10.0 mm.

5. The multi-core cable according to claim 1, further comprising:

a plurality of insulated wires within the wrapping tape, each insulated wire including a conductor whose sectional area is 0.0006 $mm^2$ to 0.25 $mm^2$.

6. The multi-core cable according to claim 2, further comprising:

a plurality of insulated wires within the wrapping tape, each insulated wire including a conductor whose sectional area is 0.0006 $mm^2$ to 0.25 $mm^2$.

7. The multi-core cable according to claim 3, further comprising:

a plurality of insulated wires within the wrapping tape, each insulated wire including a conductor whose sectional area is 0.0006 $mm^2$ to 0.25 $mm^2$.

8. The multi-core cable according to claim 4, further comprising:

a plurality of insulated wires within the wrapping tape, each insulated wire including a conductor whose sectional area is 0.0006 $mm^2$ to 0.25 $mm^2$.

* * * * *